US011846483B1

(12) United States Patent
Smathers et al.

(10) Patent No.: US 11,846,483 B1
(45) Date of Patent: Dec. 19, 2023

(54) FIREARM WITH AN AMBIDEXTROUS SLIDE STOP

(71) Applicant: ORACLE ARMS, LLC, Dayton, NV (US)

(72) Inventors: Joseph Smathers, Dayton, NV (US); Todd Powers, Dayton, NV (US)

(73) Assignee: Oracle Arms, LLC, Dayton, NV (US)

( * ) Notice: Subject to any disclaimer, the term of this patent is extended or adjusted under 35 U.S.C. 154(b) by 0 days.

(21) Appl. No.: 18/210,457

(22) Filed: Jun. 15, 2023

Related U.S. Application Data

(60) Provisional application No. 63/400,953, filed on Aug. 25, 2022.

(51) Int. Cl.
*F41A 35/06* (2006.01)
*F41A 3/66* (2006.01)
*F41A 3/72* (2006.01)

(52) U.S. Cl.
CPC ..... *F41A 35/06* (2013.01); *F41A 3/66* (2013.01); *F41A 3/72* (2013.01)

(58) Field of Classification Search
CPC ..... F41A 35/06; F41A 17/42; F41A 17/40
USPC ..... 89/138
See application file for complete search history.

(56) References Cited

U.S. PATENT DOCUMENTS

| | | | | |
|---|---|---|---|---|
| 7,313,996 | B2 * | 1/2008 | Werner | F41A 35/06 89/181 |
| 9,068,790 | B2 * | 6/2015 | La Vigne | F41A 17/36 |
| 2004/0035286 | A1 * | 2/2004 | Spinner | F41A 11/00 89/180 |

* cited by examiner

*Primary Examiner* — Reginald S Tillman, Jr.
(74) *Attorney, Agent, or Firm* — Hunton Andrews Kurth LLP

(57) ABSTRACT

The present application discloses an improved firearm design that features an ambidextrous slide stop, allowing for enhanced accessibility and functionality for both left-handed and right-handed shooters. This design provides advantages over the traditional 1911 pistol, addressing challenges faced by left-handed shooters and streamlining reloads and malfunction clearance. The application incorporates a male-female interlocking mechanism for the slide stop portions, allowing for secure and removable coupling. Additionally, a thumb pad is included for easy engagement of the slide lock. Overall, this innovation offers improved ergonomics and versatility for shooters of different handedness.

20 Claims, 5 Drawing Sheets

FIREARM WITH AN AMBIDEXTROUS SLIDE STOP

CROSS-REFERENCE TO RELATION APPLICATIONS

This application claims priority to U.S. Provisional Application No. 63/400,953 filed Aug. 25, 2022 which application is incorporated by reference herein. This application also relates to U.S. Pat. No. 984,519 filed on Feb. 17, 1910, the contents of which are incorporated herein in its entirety.

FIELD OF THE DISCLOSURE

The present disclosure relates to slide stops for firearms.

BACKGROUND

Hand pistols taught by U.S. Pat. No. 984,519, or some variation thereof, (each a "1911") have been in production for over one-hundred years. During that time, the 1911 has developed a loyal following for a variety of reasons. Unfortunately, certain features of the 1911 are not optimized. For example, the slide stop on the 1911 is not ambidextrous, i.e. the slide stop can be engaged much more easily by right-handed shooters. Accordingly, it would be beneficial to have a firearm that is capable of satisfying 1911 loyalists while improving upon certain non-optimized features.

SUMMARY OF THE DISCLOSURE

In some aspects, the techniques described herein relate to a firearm including: a frame of a handgun including a first side and a second side; a slide attached slidably to the frame including a stop notch; a slide stop attached to frame, wherein the slide stop is configured to move in and out of engagement with the slide for locking and releasing the slide, wherein the slide stop includes a first portion and a second portion both removably attached to the frame, wherein the first portion is on the first side of the frame and the second portion is on the second side of the frame; wherein the first portion includes a lever, a shaft extending perpendicularly from the distal end of the lever, and a stopper extending from the proximal end of the lever configured to mate with the stop notch, the lever extending along the outer surface of the frame facilitating the operation of the slide stop; wherein the second portion includes a lever; wherein the slide stop further includes a mating mechanism between the first portion and the second portion, wherein the mating mechanism further includes a male mating mechanism on the first portion and a female mating mechanism on the second portion, wherein the male mating mechanism is a protrusion extending from the shaft, and the female mating mechanism is a protrusion extending perpendicularly from the lever of the second portion; wherein the first portion and the second portion, upon mating with each other via the mating mechanism move operably with one another such that engaging the stopper with the slide stop notch is achievable with either hand of a user.

Further features of the disclosed systems and methods, and the advantages offered thereby, are explained in greater detail hereinafter with reference to specific example embodiments illustrated in the accompanying drawings.

BRIEF DESCRIPTION OF THE DRAWINGS

In order to facilitate a fuller understanding of the present application, reference is now made to the attached drawings. The drawings should not be construed as limiting the present application but are intended only to illustrate different aspects and embodiments of the application.

The present application comprises a 1911 hand pistol modified with an ambidextrous slide stop. The ambidextrous slide stop facilitates locking and releasing the slide during left-handed and right-handed operation of the firearm.

DETAILED DESCRIPTION

Figure 1:
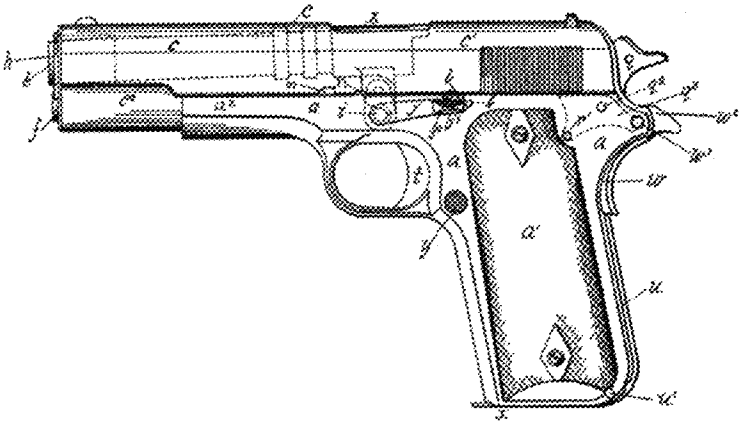
FIG. 1 illustrates side view of a hand pistol of the prior art, the image taken from U.S. Pat. No. 984,519 (FIG. 1), the pistol shown in a rest configuration.

Exemplary embodiments of the application will now be described in order to illustrate various features. The embodiments described herein are not intended to be limiting as to the scope of the application, but rather are intended to provide examples of the components, use, and operation of the embodiments.

Furthermore, the described features, advantages, and characteristics of the embodiments may be combined in any suitable manner. One skilled in the relevant art will recognize that the embodiments may be practiced without one or more of the specific features or advantages of an embodiment. In other instances, additional features and advantages may be recognized in certain embodiments that may not be present in all embodiments.

Like the 1911, the firearm disclosed in the present embodiments includes a frame, a slide, and a slide stop for locking and releasing the slide during operation of the firearm. Unlike the 1911, the present firearm includes a slide stop is an ambidextrous slide stop that facilitates locking and releasing the slide during left-handed and right-handed operation of the firearm.

The application provides improvements upon the 1911. For example, the ambidextrous slid stop provides improved accessibility for left-handed shooters. The 1911 pistol traditionally features a slide stop/release on the left side of the frame, which can be challenging for left-handed shooters to operate comfortably. By adding an ambidextrous slide stop, left-handed shooters can easily manipulate the slide stop with their dominant hand, enhancing their ability to quickly and effectively engage the slide. As another example, the disclosed slide stop can streamline reloads and malfunction clearance. The ambidextrous slide stop simplifies the process of conducting slide lock reloads. Shooters can use their thumb or index finger of either hand to engage the slide stop, facilitating faster and more efficient reloading. Additionally, in the case of a malfunction, the ability to manipulate the slide stop with either hand allows for easier clearance of the malfunction and faster readiness for subsequent shots. Finally, the ambidextrous slide stop improves the consistency of each shooter in relation to the handgun. With an ambidextrous slide stop, shooters can maintain a consistent grip and shooting stance regardless of hand dominance. This consistency can aid in training and muscle memory development, as shooters can perform reloads and other manipulations using the same technique regardless of which hand they use to engage the slide stop.

Unlike conventional or existing slide stops such as U.S. Pat. No. 9,068,790 B2, the application does not rely on springs to function. Furthermore, this application does not require one side of the slide stop to be removed first before removing the other from the frame of the firearm. Indeed, there are no screws, pins, or other similar attachment means in many but not all of the embodiments. Rather, this application can use only a mating mechanism to removably attach the slide stop to the frame.

FIG. 1 illustrates side view of a hand pistol of the prior art, the image taken from U.S. Pat. No. 984,519 (FIG. 1), the pistol shown in a rest configuration. The slide stop present in this 1911 pistol is configured for right hand shooters.

Figure 2:
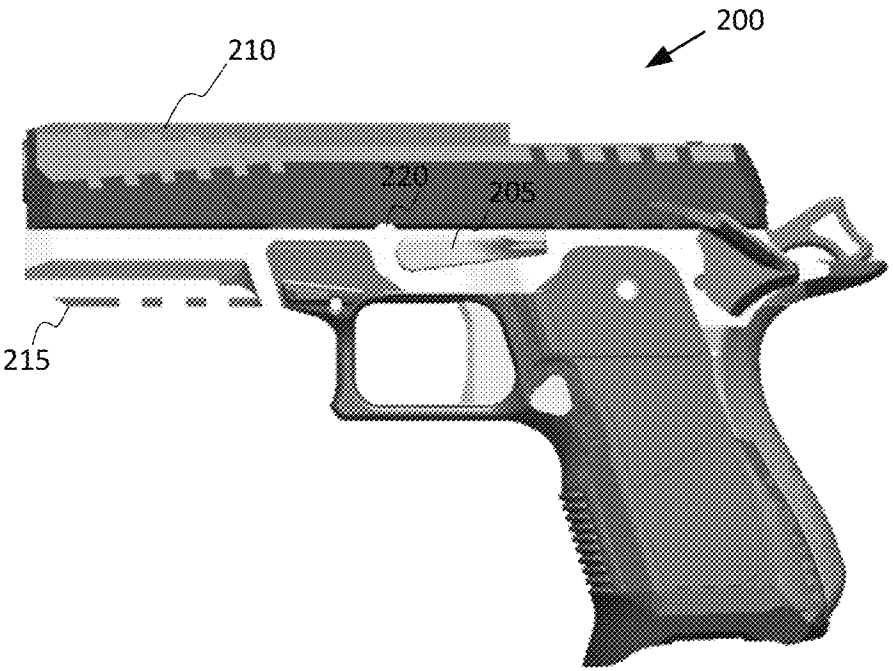
FIG. 2 is a side view of a hand pistol of the present application, the hand pistol having an ambidextrous slide stop.

FIG. 2 illustrates a firearm 200 of the present application including a frame 215, a slide 210 slidably coupled to the frame 215, and a slide stop 205 coupled to the frame 215, the slide stop 205 being configured to move in and out of engagement with the slide 210, thereby locking or releasing the slide, respectively. The slide stop 205 is an ambidextrous slide stop having left and right portions associated with a respective left and right sides of the frame 215. The slide stop 205 can be configured to engage with the slide stop notch 220 thereby stopping the slide 210 from moving.

Figure 3B:
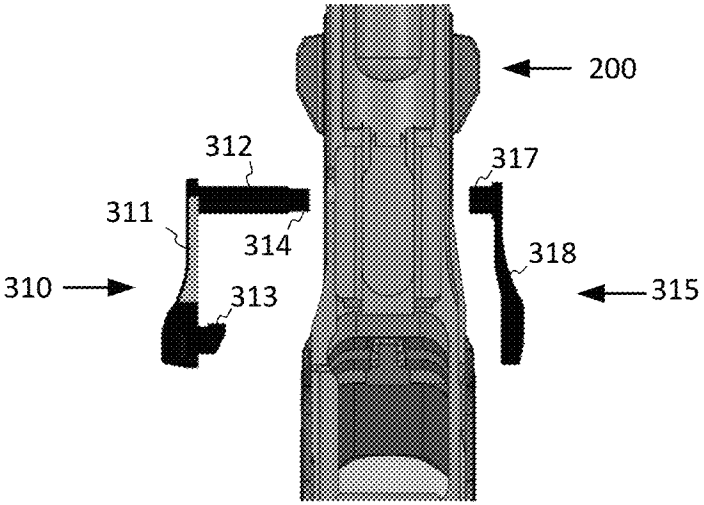
FIGS. 3A and 3B s a partial sectional view of the hand pistol of FIG. 2.
Figure 3A:
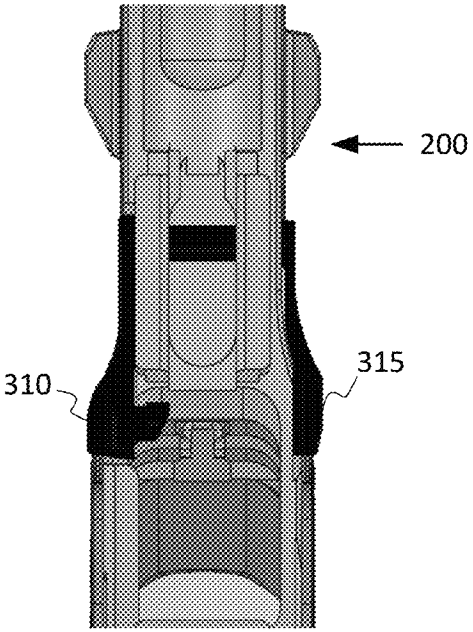

FIG. 3A and 3B are top-down views of the firearm 200 with the slide stop having a first portion 310 and a second portion 315 attached removably to the frame 215. In FIGS. 3A and 3B, the first portion 310 is on the left side of the firearm 200 while the second portion 315 is on the right side of the firearm 200. In other embodiments, the positions of the portions may be switched, e.g. the first portion 310 can be configured to fit the right side of the firearm 200 while the second portion 315 can be configured to fit the left side of the firearm 200. In FIG. 3A, the first portion 310 and second portion 315 are coupled to one another, and they are also coupled to the frame 215. In FIG. 3B, the first portion 310 and second portion 315 are uncoupled from each other and the frame. The first portion 310 can include a lever 311 and a shaft 312 extending from the lever 311. The shaft 312 can extend into the frame 215. The lever 311 can extend along the outer surface of the frame 215, thereby facilitating operation of the slide stop. The first portion 310 can further include a stopper 313 which can be configured to stop the slide 210 upon the user pushing the stopper 313 into a slide stop notch 220.

The second portion 315 can include a lever arm 318 which can be moved by the user. The first portion 310 and the second portion 315 can be interlocked by an interlocking mechanism including a male mating mechanism 314 on the first portion 310 and a female mating mechanism 317 on the second portion 315. The male mating mechanism 314 can be a protrusion or projection from the distal end of the shaft 312 without any recess. The female mating mechanism 317 can also include a protrusion or projection but perpendicular from the lever arm 318 at the distal end of lever arm 318. The male mating mechanism 314 is configured to mate removably with the female mating mechanism 317. The mechanisms 314 and 317 are configured to mate such that first portion 310 and second portion 315 move operably with one another such that a shooter can engage the stopper 313 with the slide stop notch 220 with either hand whether the shooter is left-handed or right-handed. That is, once the portions are connected, any movement of the first portion 310 necessarily results in movement of the second portion 315 and vice versa.

Though not visually depicted in FIGS. 3A-3B, the frame can also include slots configured to fit the male mating mechanism of the first portion 310 and the female mating mechanism of the second portion 315. That is, the frame of the handgun can include two specific slots that are designed to accommodate the male and female mating mechanisms of the first and second portions of the slide stop, respectively. The slide stop slots serve as dedicated housing areas within the frame where the first and second portions of the slide stop are inserted and engaged. They ensure that the slide stop remains properly aligned and in its designated position during firearm operation. A concrete example of these slide stop slots could be two parallel channels located on the frame of the handgun. These channels are precisely machined or molded to match the dimensions and shape of the male mating mechanism on the first portion 310 and the female mating mechanism on the second portion 315 of the slide stop 205. When assembling the slide stop 205, the user would align the male mating mechanism of the first portion 310 with one of the slide stop slots, and the female mating mechanism of the second portion 315 with the other slide stop slot. This alignment allows the slide stop 205 to fit securely into the frame 215, enabling the proper functioning and movement of the slide stop mechanism. By having these specific slide stop slots, the firearm design enhances the stability, reliability, and overall performance of the slide stop mechanism. It provides a secure and consistent attachment point for the slide stop components, allowing for smooth and controlled engagement and disengagement of the slide stop with the slide stop notch.

In some embodiments, the first portion 310 and the second portion 315 of the slide stop 205 are designed in such a way that they can be swapped or exchanged with each other without any modifications or adjustments to the firearm frame 215. That is, the first and second portions of the slide stop 205 could involve a modular design approach. The first and second portions can be manufactured as separate components that are identical in shape, size, and function. They would have compatible attachment mechanisms and mating features, allowing them to be easily removed from the frame 215 and interchanged with one another. For instance, the first portion 310 and the second portion 315 of the slide stop 205 might have corresponding connectors or fasteners that facilitate their attachment to the frame 215. These connectors could be screws, pins, or other mechanisms that secure the slide stop in place. Interchangeability offers benefits such as adaptability to different hand sizes or shooting techniques. Some users may prefer a larger thumb pad on one side or a different lever design, and being able to interchange the portions allows for personalization to suit individual needs. Additionally, interchangeability simplifies maintenance and repairs. If one portion becomes damaged or worn out, it can be replaced independently without replacing the entire slide stop 205 assembly.

Figure 4A:
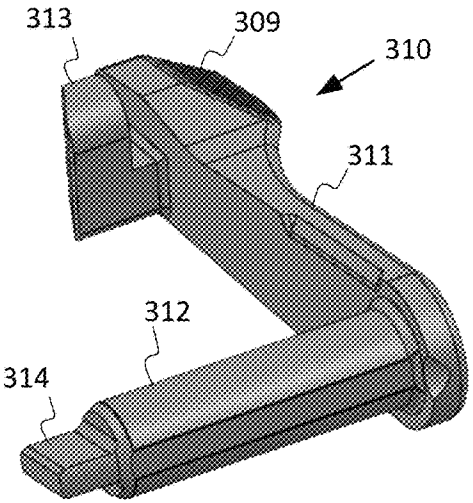
FIGS. 4A and 4B are perspective views of a left and right portion of a slide stop as disclosed in the present application.
Figure 4B:
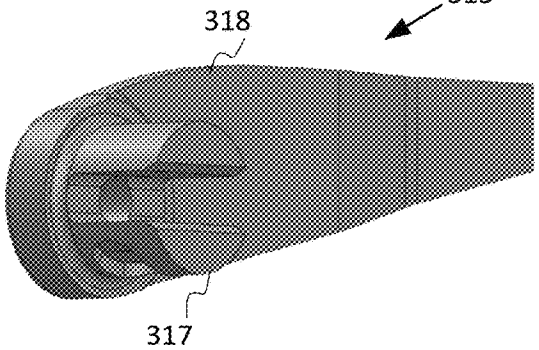

FIGS. 4A and 4B illustrate the first portion 310 and the second portion 315 in greater detail. In addition to the elements discussed above, the first portion 310 can further include a thumb pad 309 configured to be pressed by the shooter's thumb or finger. The thumb pad 309 can make it easier for the shooter to engage the slide stop 205. The thumb pads on either or both the first portion 310 and the second portion 315 can be textured. That is, either the second lever 315, the first lever 311, or both of them in the slide stop 205 have a thumb pad, which is a designated area for the user's thumb to interact with, and this thumb pad has a textured surface. As a nonlimiting example, a thumb pad with a textured surface on the second lever 315 and/or the first lever 311 of the slide stop 205 could involve adding a raised area or a protrusion on the lever's surface. This raised area can have a textured pattern, such as stippling, checkering, or grooves, which provide a tactile grip or enhanced friction for the user's thumb. The textured surface on the thumb pad serves multiple purposes. First, it improves the user's grip and control over the slide stop 205, particularly when manipulating it to engage or disengage the slide. The textured surface helps prevent the thumb from slipping or losing traction during operation, ensuring a secure and confident thumb placement. Second, the textured surface can assist in quick and intuitive thumb recognition. By providing a distinct tactile sensation, the user can easily locate and activate the slide stop 205 without needing to visually confirm its position, especially in fast-paced or high-stress situations.

Figure 5:
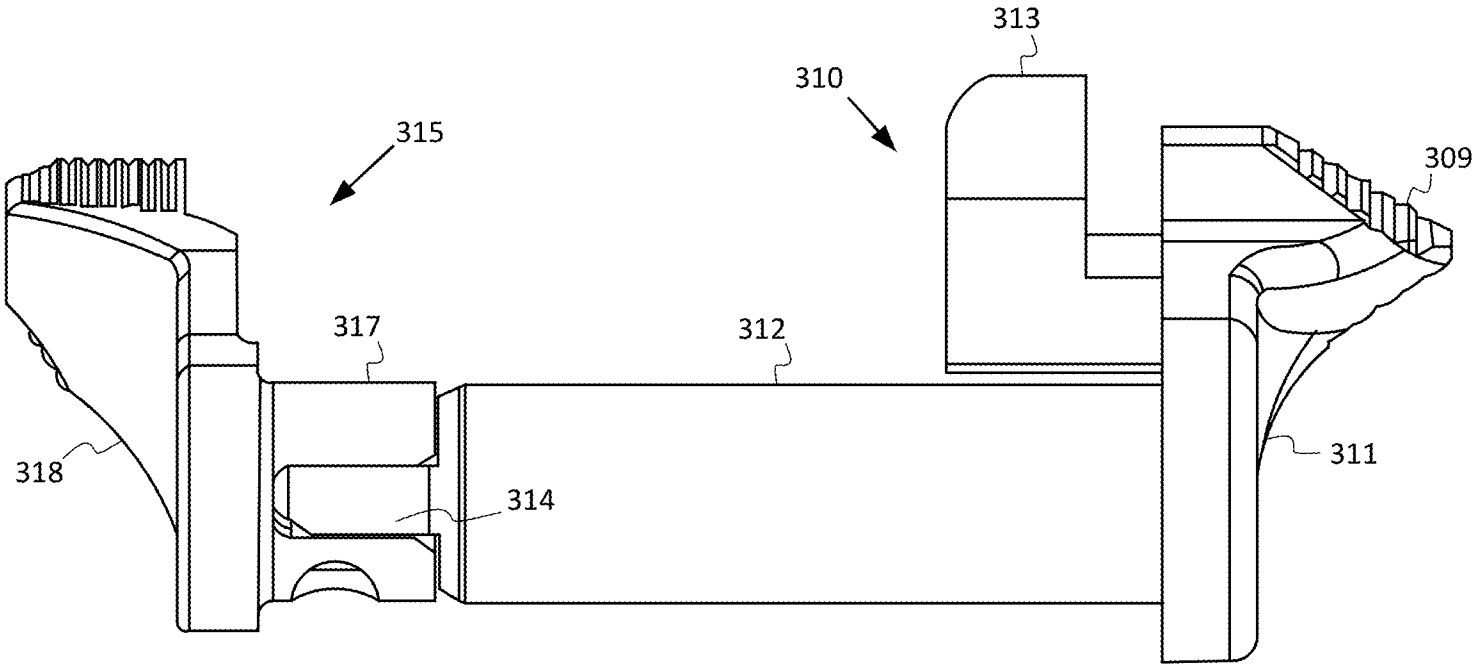
FIG. 5 is a view of the slide stop without the handgun.

FIG. 5 illustrates the first portion 310 and the second portion 315 mated together but outside the context of the frame 215. As depicted, the first and second portions can be mated by snugly fitting each portion to one another. The first and second portions can be configured at least in some embodiments to have chamfered edges. As a nonlimiting example, the chamfered edges on the first and second portions of the slide stop 205 could involve beveled or angled surfaces along the outer edges of these components. The chamfered edges are typically created by removing material at a specific angle or slope, resulting in a sloping transition between different surfaces. Chamfered edges serve two purposes in the context of the slide stop 205. First, they can enhance the ergonomics of the slide stop 205 by providing smoother and more comfortable contact points for the user's fingers during operation. The beveled edges reduce sharp corners and edges, minimizing the potential for discomfort or irritation during extended firearm handling. Second, chamfered edges can help prevent snagging or catching on clothing, holsters, or other objects while drawing or manipulating the firearm 200. The angled surfaces create a more streamlined profile, reducing the likelihood of obstructions impeding the smooth movement of the slide stop 205.

In some embodiments, the mating mechanism between the first portion 310 and the second portion 315 of the slide stop 205 can include a locking mechanism configured to prevent accidental disengagement during an operation of the firearm 203. When the slide stop 205 is in the engaged position, the detent ball would securely engage the notch, creating a positive locking mechanism. This locking mechanism prevents the slide stop from inadvertently disengaging due to recoil, vibration, or other external forces that may be experienced during firearm operation. To disengage the slide stop 205 intentionally, the user would need to apply a specific amount of force or manipulate the slide stop 205 in a deliberate manner to overcome the resistance provided by the locking mechanism. This ensures that the slide stop 205 remains engaged during normal operation but can still be readily released when intended.

In still other embodiments, the slide stop 205 can be combined with other useful elements such as a visual indicator configured to indicate the status of the slide stop's engagement with the slide stop notch 220. That is, the slide stop 205 can include a visual indicator that is specifically designed to provide information about the status of the slide stop's engagement with the slide stop notch 220 on the firearm 200. A nonlimiting example of a visual indicator could be a small window or cutout on the slide stop 205 itself, which allows the user to visually inspect and determine whether the slide stop 205 is engaged or disengaged with the slide stop notch 220. For instance, when the slide stop 205 is in the engaged position, the visual indicator might show a colored dot or line, indicating that the slide stop 205 is securely locking the slide in place. This visual cue gives the user immediate feedback that the slide 210 is properly locked and ready for operation. On the other hand, when the slide stop 205 is disengaged or released, the visual indicator might show an absence of color or a different pattern, signaling that the slide stop 205 is not engaged with the slide stop notch 220. This visual cue serves as a reminder to the user that the slide 210 can freely move and that the firearm 200 may need to be reloaded or attended to.

In still other embodiments, the first portion 310 and the second portion 315 of the slide stop 205 have specific alignment features that facilitate their proper mating or connection with each other via their respective mating mechanisms. A nonlimiting example of alignment features for mating on the first and second portions of the slide stop 210 would involve corresponding recesses and protrusions. These features are designed to align the two portions precisely when they are brought together during assembly. For instance, the first portion 310 of the slide stop 205 might have a recess or groove machined into its surface, while the second portion 315 could have a corresponding protrusion or ridge that fits snugly into the recess. This ensures that when the two portions are joined, they align perfectly, allowing for a secure and stable connection. Alignment features can play a crucial role in ensuring the proper functioning of the slide stop 205. They prevent misalignment, wobbling, or unintended movement of the slide stop 205 during firearm operation, which could compromise the reliability and safety of the firearm 200. By incorporating alignment features, the first and second portions of the slide stop 205 can be easily and accurately positioned relative to each other, ensuring a precise and consistent engagement and disengagement of the slide stop 205 with the stop notch 220 of the handgun slide 210. These alignment features simplify the assembly process for the user, enabling them to quickly and accurately join the first and second portions without the need for complex adjustments or excessive force.

In some aspects, the techniques described herein relate to a firearm including: a frame of a handgun including an outer surface with a first side and a second side; a slide attached slidably to the frame including a stop notch; and a slide stop attached to frame, wherein the slide stop is configured to move in and out of engagement with the slide for locking and releasing the slide, wherein the slide stop includes a first portion and a second portion both removably attached to the frame, wherein the first portion is on the first side of the frame and the second portion is on the second side of the frame; wherein the first portion includes a first lever with a proximal end and a distal end, a shaft extending perpendicularly from the distal end of the first lever, and a stopper extending from the proximal end of the first lever configured to mate with the stop notch, the first lever extending along the outer surface of the frame facilitating the operation of the slide stop; wherein the second portion includes a second lever; wherein the slide stop further includes a mating mechanism between the first portion and the second portion, wherein the mating mechanism further includes a male mating mechanism on the first portion and a female mating mechanism on the second portion, wherein the male mating mechanism is a protrusion extending from the shaft, and the female mating mechanism is a protrusion extending perpendicularly from the second lever; wherein the first portion and the second portion, upon mating with each other via the mating mechanism move operably with one another such that engaging the stopper with the slide stop notch is achievable with either hand of a user.

In some aspects, the techniques described herein relate to a firearm, wherein the firearm further includes a thumb pad on the first portion, facilitating engagement of the slide stop by the user's thumb or finger.

In some aspects, the techniques described herein relate to a firearm, wherein the firearm further includes an adjustable tension mechanism on the first portion to customize the force required for engaging and disengaging the stop notch.

In some aspects, the techniques described herein relate to a firearm, wherein the first portion and the second portion of the slide stop further include alignment features for mating.

In some aspects, the techniques described herein relate to a firearm, wherein the mating mechanism between the first portion and the second portion of the slide stop further includes a locking mechanism configured to prevent accidental disengagement during an operation of the firearm.

In some aspects, the techniques described herein relate to a firearm, wherein the first portion and the second portion of the slide stop are configured to be interchangeable.

In some aspects, the techniques described herein relate to a firearm, wherein the slide stop further includes a visual indicator configured to indicate the status of the slide stop's engagement with the slide stop notch.

In some aspects, the techniques described herein relate to a firearm, wherein the frame includes two slide stop slots configured to fit the male mating mechanism of the first portion and the female mating mechanism of the second portion.

In some aspects, the techniques described herein relate to a firearm, wherein the slide stop is made of at least one selected from the group of steel, aluminum, and titanium.

In some aspects, the techniques described herein relate to a device including: a slide stop configured to be attached to a frame of a handgun, wherein the slide stop is configured to move in and out of engagement with a handgun slide including a stop notch for locking and releasing the handgun slide on the handgun, wherein the slide stop includes a first portion configured to be removably attached to a first side of the frame and a second portion configured to be removably attached to a second side of the frame; wherein the first portion includes a first lever with a distal end and a proximal end, a shaft extending substantially perpendicularly from the distal end of the first lever, and a stopper extending from the proximal end of the first lever configured to mate with the stop notch, the first lever configured to extend along the outer surface of the frame to facilitate the operation of the slide stop; wherein the second portion includes a second lever; wherein the slide stop further includes a mating mechanism between the first portion and the second portion, wherein the mating mechanism further includes a male mating mechanism on the first portion and a female mating mechanism on the second portion, wherein the male mating mechanism is a protrusion extending from the shaft, and the female mating mechanism is a protrusion extending perpendicularly from the second lever; wherein the first portion and the second portion, upon mating with each other via the mating mechanism are configured to move operably with one another such that a user can engage the stopper on the first side of the frame or the second side of the frame.

In some aspects, the techniques described herein relate to a device, wherein the slide stop is made of at least one selected from the group of polymer, thermoplastic, and polycarbonate.

In some aspects, the techniques described herein relate to a device, wherein the first lever of the slide stop further includes a thumb pad with a textured surface.

In some aspects, the techniques described herein relate to a device, wherein the second lever of the slide stop further includes a thumb pad with a textured surface.

In some aspects, the techniques described herein relate to a device, wherein the first portion and the second portion further include chamfered edges.

In some aspects, the techniques described herein relate to a device, wherein the first portion and the second portion of the slide stop are reversible and can be interchanged.

In some aspects, the techniques described herein relate to a slide stop for a handgun, including: a first portion configured to be removably attached to a side of a frame of a handgun; a second portion configured to be removably attached to an opposite side of the frame of the handgun; the first portion including a lever with a distal end and a proximal end, a shaft extending substantially perpendicularly from the distal end of the lever, and a stopper extending from the proximal end of the lever, the stopper configured to mate with a stop notch on a handgun slide for locking and releasing the handgun slide; the second portion including a lever; and a mating mechanism between the first portion and the second portion, wherein the mating mechanism includes a male mating mechanism on the first portion and a female mating mechanism on the second portion, wherein the male mating mechanism is a protrusion extending from the shaft, and the female mating mechanism is a protrusion extending perpendicularly from the second lever, and the first portion and the second portion, upon mating with each other via the mating mechanism, are configured to move operably with one another such that a user can engage the stopper on either side of the frame.

In some aspects, the techniques described herein relate to a slide stop, wherein the first portion and the second portion of the slide stop are configured to be interchangeable.

In some aspects, the techniques described herein relate to a slide stop, wherein the first lever of the slide stop further includes a thumb pad with a textured surface.

In some aspects, the techniques described herein relate to a slide stop, wherein the second lever of the slide stop further includes a thumb pad with a textured surface.

In some aspects, the techniques described herein relate to a slide stop, wherein the slide stop further includes a visual indicator configured to indicate the status of the slide stop's engagement with the slide stop notch.

In some aspects, reference made to a firearm 200 is meant to include the following elements found in conventional handguns such as without limitation: a frame; slide, barrel; trigger; hammer; firing pin; sight; grip; magazine; trigger guard; safety; slide release; extractor; ejector; recoil spring; magazine release; magazine base plate; disconnector; sear; sear spring; magazine follower; magazine spring; and pin retainers. One or more of these elements can be included in the term "frame," "firearm," or both.

It is understood that some or all of the devices or elements thereof can be made or manufactured out of one or more materials. These materials can include without limitation: steel; stainless steel; aluminum; titanium; a zinc alloy; brass; polymer; fiberglass; thermoplastic; polyethylene; polyamide; polycarbonate; and polypropylene. The use of different materials for the first and second portions of the slide stop offers several advantages. By allowing a combination of metal, polymer, and composite materials, the firearm manufacturer can optimize the slide stop's performance and functionality. For example, using a metal material for the first portion 310, such as steel or aluminum, can provide strength and durability to withstand the forces involved in locking and releasing the handgun slide 210. On the other hand, employing a polymer or composite material for the second portion 315 can contribute to weight reduction, enhancing the overall maneuverability and ergonomics of the firearm. Additionally, the choice of materials for each portion can be tailored to specific requirements, such as corrosion resistance, impact absorption, or friction reduction. This versatility in material selection for the first and second portions of the slide stop 205 enables firearm designers to achieve the desired balance of strength, weight, and performance characteristics, ultimately enhancing the overall user experience and satisfaction.

Although some elements with reference to the firearm have been described, they are not exhaustive. Other elements can be added to make the slide stop more versatile, user friendly, or mechanically sound. For example, the firearm 200 can include an adjustable tension mechanism on the first portion 310 to customize the force required for engaging and disengaging the stop notch 220. This mechanism allows the user to customize or adjust the amount of force or tension required to engage and disengage the stop notch 220 on the handgun slide 210. For example, the adjustable tension mechanism could be a small screw or set screw embedded within the first portion 310 of the slide stop 205. By turning the screw clockwise or counterclockwise, the user can increase or decrease the tension applied to the stop notch 220. For instance, when the tension is set to a higher level, it would require more force or effort from the user to engage or disengage the slide stop 205. This can provide added security and prevent accidental engagement or disengagement of the slide stop 205 during firearm operation. Conversely, if the tension is set to a lower level, it would reduce the force required to operate the slide stop 205. This can be useful for users who prefer a smoother and easier slide stop operation or for individuals who may have limited hand strength.

Although embodiments of the present application have been described herein in the context of a particular implementation in a particular environment for a particular purpose, those skilled in the art will recognize that its usefulness is not limited thereto and that the embodiments of the present application can be beneficially implemented in other related environments for similar purposes. The application should therefore not be limited by the above-described embodiments, method, and examples, but by all embodiments within the scope and spirit of the embodiments as claimed.

Further, it is to be understood that the terminology used herein is for the purpose of describing particular embodiments only and is not intended to be limiting. The terms "a" or "an" as used herein, are defined as one or more than one. The term "plurality" as used herein, is defined as two or more than two. The term "another" as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper," "lower," "left," "rear," "right," "front," "vertical," "horizontal," and derivatives thereof relate to the application as oriented in the figures and is not to be construed as limiting any feature to be a particular orientation, as said orientation may be changed based on the user's perspective of the device.

In the application, various embodiments have been described with references to the accompanying drawings. It may, however, be evident that various modifications and changes may be made thereto, and additional embodiments may be implemented, without departing from the broader scope of the embodiments as set forth in the claims that follow. The application and drawings are accordingly to be regarded in an illustrative rather than restrictive sense.

The application is not to be limited in terms of the particular embodiments described herein, which are intended as illustrations of various aspects. Many modifications and variations can be made without departing from its spirit and scope. Functionally equivalent systems, processes and apparatuses within the scope of the application, in addition to those enumerated herein, may be apparent from the representative descriptions herein. Such modifications and variations are intended to fall within the scope of the appended claims. The application is to be limited only by the terms of the appended claims, along with the full scope of equivalents to which such representative claims are entitled.

The preceding description of exemplary embodiments provides non-limiting representative examples referencing numerals to particularly describe features and teachings of different aspects of the application. The embodiments described should be recognized as capable of implementation separately, or in combination, with other embodiments from the description of the embodiments. A person of ordinary skill in the art reviewing the description of embodiments should be able to learn and understand the different described aspects of the application. The description of embodiments should facilitate understanding of the application to such an extent that other implementations, not specifically covered but within the knowledge of a person of skill in the art having read the description of embodiments, would be understood to be consistent with an application of the application.

What is claimed is:

1. A firearm comprising:

a frame of a handgun comprising an outer surface with a first side and a second side;

a slide attached slidably to the frame comprising a stop notch; and a slide stop attached to frame, wherein the slide stop is configured to move in and out of engagement with the slide for locking and releasing the slide, wherein the slide stop comprises a first portion and a second portion both removably attached to the frame, wherein the first portion is on the first side of the frame and the second portion is on the second side of the frame;

wherein the first portion comprises a first lever with a proximal end and a distal end, a shaft extending perpendicularly from the distal end of the first lever, and a stopper extending from the proximal end of the first lever configured to mate with the stop notch, the first lever extending along the outer surface of the frame facilitating the operation of the slide stop;

wherein the second portion comprises a second lever;

wherein the slide stop further comprises a mating mechanism between the first portion and the second portion, wherein the mating mechanism further comprises a male mating mechanism on the first portion and a female mating mechanism on the second portion, wherein the male mating mechanism is a protrusion extending from the shaft, and the female mating mechanism is a protrusion extending perpendicularly from the second lever;

wherein the first portion and the second portion, upon mating with each other via the mating mechanism move operably with one another such that engaging the stopper with the slide stop notch is achievable with either hand of a user.

2. The firearm of claim 1, wherein the firearm further comprises a thumb pad on the first portion, facilitating engagement of the slide stop by the user's thumb or finger.

3. The firearm of claim 1, wherein the firearm further comprises an adjustable tension mechanism on the first portion to customize the force required for engaging and disengaging the stop notch.

4. The firearm of claim 1, wherein the first portion and the second portion of the slide stop further comprise alignment features for mating.

5. The firearm of claim 1, wherein the mating mechanism between the first portion and the second portion of the slide stop further comprises a locking mechanism configured to prevent accidental disengagement during an operation of the firearm.

6. The firearm of claim 1, wherein the first portion and the second portion of the slide stop are configured to be interchangeable.

7. The firearm of claim 1, wherein the slide stop further comprises a visual indicator configured to indicate the status of the slide stop's engagement with the slide stop notch.

8. The firearm of claim 1, wherein the frame comprises two slide stop slots configured to fit the male mating mechanism of the first portion and the female mating mechanism of the second portion.

9. The firearm of claim 1, wherein the slide stop is made of at least one selected from the group of steel, aluminum, and titanium.

10. A device comprising:

a slide stop configured to be attached to a frame of a handgun, wherein the slide stop is configured to move in and out of engagement with a handgun slide comprising a stop notch for locking and releasing the handgun slide on the handgun, wherein the slide stop comprises a first portion configured to be removably attached to a first side of the frame and a second portion configured to be removably attached to a second side of the frame;

wherein the first portion comprises a first lever with a distal end and a proximal end, a shaft extending substantially perpendicularly from the distal end of the first lever, and a stopper extending from the proximal end of the first lever configured to mate with the stop notch, the first lever configured to extend along the outer surface of the frame to facilitate the operation of the slide stop;

wherein the second portion comprises a second lever;

wherein the slide stop further comprises a mating mechanism between the first portion and the second portion, wherein the mating mechanism further comprises a male mating mechanism on the first portion and a female mating mechanism on the second portion, wherein the male mating mechanism is a protrusion extending from the shaft, and the female mating mechanism is a protrusion extending perpendicularly from the second lever;

wherein the first portion and the second portion, upon mating with each other via the mating mechanism are configured to move operably with one another such that a user can engage the stopper on the first side of the frame or the second side of the frame.

11. The device of claim 10, wherein the slide stop is made of at least one selected from the group of polymer, thermoplastic, and polycarbonate.

12. The device of claim 10, wherein the first lever of the slide stop further comprises a thumb pad with a textured surface.

13. The device of claim 10, wherein the second lever of the slide stop further comprises a thumb pad with a textured surface.

14. The device of claim 10, wherein the first portion and the second portion further comprise chamfered edges.

15. The device of claim 10, wherein the first portion and the second portion of the slide stop are reversible and can be interchanged.

16. A slide stop for a handgun, comprising:

a first portion configured to be removably attached to a side of a frame of a handgun;

a second portion configured to be removably attached to an opposite side of the frame of the handgun;

the first portion comprising a lever with a distal end and a proximal end, a shaft extending substantially perpendicularly from the distal end of the lever, and a stopper extending from the proximal end of the lever, the stopper configured to mate with a stop notch on a handgun slide for locking and releasing the handgun slide;

the second portion comprising a lever; and a mating mechanism between the first portion and the second portion, wherein the mating mechanism comprises a male mating mechanism on the first portion and a female mating mechanism on the second portion, wherein the male mating mechanism is a protrusion extending from the shaft, and the female mating mechanism is a protrusion extending perpendicularly from the second lever, and the first portion and the second portion, upon mating with each other via the mating mechanism, are configured to move operably with one another such that a user can engage the stopper on either side of the frame.

17. The slide stop of claim 16, wherein the first portion and the second portion of the slide stop are configured to be interchangeable.

18. The slide stop of claim 16, wherein the first lever of the slide stop further comprises a thumb pad with a textured surface.

19. The slide stop of claim 16, wherein the second lever of the slide stop further comprises a thumb pad with a textured surface.

20. The slide stop of claim 16, wherein the slide stop further comprises a visual indicator configured to indicate the status of the slide stop's engagement with the slide stop notch.

* * * * *